US005456783A

United States Patent [19]

Sissons

[11] Patent Number: 5,456,783

[45] Date of Patent: Oct. 10, 1995

[54] APPARATUS AND METHOD FOR ENHANCING HEATING UNIFORMITY FOR SETTING ADHESIVE IN CORRUGATED PAPERBOARD MANUFACTURING

[75] Inventor: Anthony J. Sissons, Gastonia, N.C.

[73] Assignee: Interfic Developments Incorporated, Gastonia, N.C.

[21] Appl. No.: 58,912

[22] Filed: May 6, 1993

[51] Int. Cl.[6] ..... B31F 1/20; B31F 1/28

[52] U.S. Cl. ..... 156/210; 156/205; 156/470; 156/583.5; 271/198; 271/274

[58] Field of Search ..... 156/470, 210, 156/583.5, 205; 425/364 R, 371; 271/198, 274; 198/837, 838; 100/151, 153, 154

[56] References Cited

U.S. PATENT DOCUMENTS

| | | | |
|---|---|---|---|
| 2,252,585 | 8/1941 | Swanson et al. . | |
| 2,300,982 | 11/1942 | Slagboom et al. . | |
| 2,508,216 | 5/1950 | Bonds et al. | 100/151 |
| 2,554,968 | 5/1951 | Thompson | 100/151 |
| 2,941,573 | 6/1960 | Cassady . | |
| 3,217,425 | 9/1962 | Nikkel . | |
| 3,319,353 | 5/1967 | Matsunami et al. . | |
| 3,468,734 | 9/1969 | Shields | 156/210 |
| 3,676,268 | 7/1972 | Brandenburg et al. | 156/470 X |
| 3,981,758 | 9/1976 | Thayer et al. . | |
| 4,042,446 | 8/1977 | Lawton | 156/470 X |
| 4,080,241 | 3/1978 | Grevich et al. | 100/154 X |
| 4,128,677 | 12/1978 | Hoelzinger . | |
| 4,268,341 | 5/1981 | Huhne . | |
| 4,306,932 | 12/1981 | Bradatsch et al. . | |
| 4,316,755 | 2/1982 | Flaum et al. . | |
| 4,467,537 | 8/1984 | Tröscher . | |
| 4,887,362 | 12/1989 | Rautakorpi . | |
| 5,181,330 | 1/1993 | Schoch . | |
| 5,256,240 | 10/1993 | Shortt | 156/470 |

FOREIGN PATENT DOCUMENTS 2233935 1/1991 United Kingdom .

OTHER PUBLICATIONS

Peter Horton, *"The Short–Press Heat Transfer System"*, Presented at the 1992 Corrugated Containers Conference, (Washington, D.C. Oct. 11–15, 1992).

*"A Practical Solution to Double Facer Problems"*, International Paper Board Industry, pp. 34–36, Jan. 1993.

Reprint of article published in International Paper Board Industry, Jan. 1993, entitled "Shortpress, A Practical Solution to Double Facer Problems" from SCM Container Machinery.

Five photographs and a schematic drawing of an embodiment of Shortpress apparatus of SCM Container Machinery in a commercial installation.

*Primary Examiner*—Michele K. Yoder

*Attorney, Agent, or Firm*—Allen, Dyer, Doppelt, Franjola & Milbrath

[57] ABSTRACT

An apparatus and method is disclosed for slidably contacting and pressing upon the back side of a conveyor to urge an advancing corrugated paperboard sheet into substantially uniform contact with adjacent laterally extending heating surfaces irrespective of any thermally induced deflection or bowing thereof. A plurality of heating chests arranged in side-by-side relation define the series of laterally extending heating surfaces. A conveyor belt is positioned opposite the series of heating surfaces for advancing the corrugated paperboard sheet longitudinally along a predetermined path of travel. A plurality of contact assemblies provides the sliding contact with the conveyor belt. Each contact assembly, in turn, preferably includes a plurality of contact shoes arranged in side-by-side relation and carried by a laterally extending supporting frame. The contact shoes have contact surfaces slidably contacting the back side of the conveyor belt. Respective compressed springs urge the contact surfaces of the contact shoes against the conveyor belt even in the presence of any thermally induced bowing and without causing edge crushing. The contact shoes are mounted so that each is independently movable along a path of travel into and outward from the back side of the conveyor belt and so that each is laterally pivotable with respect to its imaginary longitudinal centerline.

28 Claims, 5 Drawing Sheets

APPARATUS AND METHOD FOR ENHANCING HEATING UNIFORMITY FOR SETTING ADHESIVE IN CORRUGATED PAPERBOARD MANUFACTURING

FIELD OF THE INVENTION

This invention relates to the field of corrugated paperboard manufacturing, and more particularly, to an apparatus and method for setting the adhesive in the manufacturing of corrugated paperboard.

BACKGROUND OF THE INVENTION

Corrugated paperboard is widely used as a material for fabricating containers and for other packaging applications. Corrugated paperboard is strong, lightweight, relatively inexpensive, and may be recycled. Conventional corrugated paperboard is constructed of two opposing liners and an intervening fluted sheet secured together using an adhesive. The adhesive is typically a starch-based adhesive applied as a liquid. Accordingly, heat is transferred to the adhesive to dry or set the adhesive during manufacturing of the corrugated paperboard.

Referring to FIG. 1, a conventional so-called "double facer" 20 for setting adhesive is schematically illustrated. The double facer joins a "single faced" corrugated paperboard sheet, including a single liner and the fluted paper, together with a second liner and heats the sheet to dry or set the adhesive. This heating is typically achieved by passing the corrugated paperboard over a series of steam heating chests from left to right as shown in the illustrated double facer 20. The heating chests are typically grouped together in heating sections 21*a*–21*d*. More particularly, the corrugated paperboard is advanced over the series of steam heated chests by an endless conveyor belt 23 and its associated drive 24 to engage the sheet and advance the sheet in contact with the underlying heating chests. A lower traction belt 26 assists in advancing the sheet through the double facer.

Referring now to the cross-sectional schematic views of FIGS. 2 and 3, in a conventional double facer, a series of transversely extending rolls 25 are carried by side rails 24 (FIG. 1) and provide a downward or backing pressure on the back side of the conveyor belt 23. Thus, the rolls 25 of a conventional double facer are intended to provide a backing force to facilitate contact between the advancing corrugated sheet 27 and the underlying heating surfaces 28 of the heating chests 22. See also, for example, U.S. Pat. No. 4,316,755 to Flaum et al. and U.S. Pat. No. 3,981,758 to Thayer et al.

As shown in FIG. 2, when the apparatus is first started, the upper heating surface 28 of the heating chest 22 is substantially planar. Accordingly, the sheet 27 is evenly pressed across the heating surface by the liner backing rolls 25, and uniform heating and setting of the adhesive may be obtained. Unfortunately, as shown in FIG. 3, the heating chests 22 have a tendency to bow inward at their centers as a result of temperature differences in the walls of the heating chest. The bowing is typically more severe in an upstream heating chest 22 since the cooler corrugated paperboard produces a larger temperature differential in the upstream heating chest.

The thermally induced bow may cause a loss of contact at the center of the heating surface 28 as illustrated by the gap 30. Accordingly, heat is not properly transferred into the adjacent portion of the corrugated paperboard sheet, resulting in scrap or an inferior product, such as a sheet having blisters. Moreover, the edge portions of the sheet 27 must support the full weight of the rolls 25 as indicated by the downward directed arrows which, in turn, typically results in crushed edge portions of the sheet. The crushed edge portions also produce an inferior product or scrap.

Another drawback of backing rolls is that a relatively large number of heating chests 22 must be used to ensure that all portions of the sheet, particularly the center portion, obtain sufficient heat to set the adhesive. The additional heating chests 22 have ambient energy losses; hence, the overall energy efficiency of the process is reduced. Moreover, the additional heating chests fail to address the problem of edge crush of the corrugated paperboard sheet also caused by bowing of the heating chests.

One proposed attempt for providing uniform backing pressure to the advancing corrugated paperboard sheet is disclosed in U.S. Pat. No. 3,319,353 to Matsunami et al. The patent discloses a plurality of air chambers each having an open bottom through which compressed air from a blower is directed onto the back side of the conveyor belt. An elastic material seals the junction between the belt and the air chambers to prevent leakage. In one embodiment, the conveyor belt is porous so that the compressed air may be directed onto the corrugated sheet to further facilitate drying.

Another approach to compensate for bowing of the heating chests, is a roll system wherein each roll has a padded covering or an enlarged medial portion to attempt to conform to the bowed heating chest surface. These approaches have proven less than satisfactory. In addition, the relatively large number of rolls required for a typical application presents a considerable initial expense and an ongoing maintenance expense, such as, for example, for servicing the large number of bearings associated with the rolls.

SUMMARY OF THE INVENTION

It is therefore an object of the present invention to provide an apparatus and method for uniformly heating a corrugated paperboard sheet during the manufacture thereof despite the presence of any thermally induced bowing of the heating chests and without crushing the edge portions of the sheet.

These and other objects, features and advantages of the present invention are provided by an apparatus including sliding contact means associated with a back side of a conveyor belt for slidably contacting and pressing upon the conveyor belt to urge an advancing corrugated paperboard sheet into substantially uniform contact with adjacent laterally extending heating surfaces irrespective of any thermally induced deflection or bowing thereof. The apparatus preferably includes a plurality of heating chests arranged in side-by-side relation which define the series of laterally extending heating surfaces. In other words, the series of heating chests provides heating means for collectively defining a longitudinally extending heating surface over which the corrugated paperboard is advanced along a predetermined path of travel to heat and set the adhesive in the corrugated paperboard. A conveyor belt is positioned opposite the series of heating surfaces for advancing the corrugated paperboard sheet longitudinally along the predetermined path of travel.

The sliding contact means preferably includes a plurality of contact assemblies, each contact assembly, in turn, preferably including a plurality of contact shoes arranged in side-by-side relation and carried by a laterally extending frame. The contact shoes have contact surfaces which slidably contact adjacent portions of the back side of the conveyor belt. Bias means, such as provided by respective compressed coil springs, urges the contact surfaces of the contact shoes against the conveyor belt.

The series of individually biased contact shoes provides a substantially uniform backing pressure applied across the respective heating surface, even in the presence of any thermally induced bowing. In addition, the series of contact shoes applies a predetermined uniform pressure to the sheet to thereby overcome the edge crush tendency of the prior art roll-based systems. Moreover, because heat is more efficiently transferred to the advancing sheet by the present invention, fewer heating chests may be used, or, alternately, the apparatus may be operated at a higher speed.

Each contact assembly also preferably includes shoe mounting means for mounting each of the contact shoes to the frame so that each is independently movable along a path of travel into and outward from the heating surfaces. The shoe mounting means is preferably provided by front and rear pairs of arms and respective pivot shafts for pivotally securing opposing ends of each arm to the frame and each shoe, respectively.

To further enhance conformance of the advancing sheet to a bowed heating chest, each of the contact shoes is also preferably pivotable with respect to its imaginary longitudinal centerline. To permit this pivotal movement of the contact shoes, an enlarged or elongated opening is preferably provided in an end of the arms cooperating with the respective pivot shafts. Thus, lateral pivotal movement over a desired range is also provided by the shoe mounting means.

Contact assembly mounting means is preferably provided for mounting the plurality of contact assemblies so that each contact assembly is associated with a respective laterally extending heating surface. The mounting means preferably mounts the contact assemblies to the opposing side rails of the apparatus. Accordingly, substantially complete coverage of each of the heating surfaces may be achieved. The contact assembly mounting means also preferably arranges adjacent assemblies in laterally staggered relation to laterally offset longitudinally extending gaps between the contact shoes of the adjacent assemblies.

Each of the contact assemblies also preferably includes stop means operatively connected between the frame and each of the contact shoes for setting a minimum clearance between the contact shoe and the heating surface. In other words, the stop means defines a stopping point along the path of travel into the back side of said conveyor belt. The stop means may be selectively adjusted to provide backing pressure for a sheet having a minimum predetermined thickness while preventing each contact shoe from fully pressing against adjacent portions of the back side of the conveyor belt when the apparatus is operated without the corrugated paperboard sheet in place adjacent a respective portion of said conveyor belt, such as during start-up of the apparatus or when manufacturing a sheet having a width less than the full width of the conveyor belt.

Each contact shoe is preferably provided by a generally rectangular plate having an upturned leading end to facilitate sliding contact with the conveyor belt. In other words, the upturned end prevents snagging on the moving conveyor belt. All of the plates also have substantially uniform dimensions to simplify construction and maintenance of the contact assemblies.

Another aspect of the present invention is that one or more of the contact assemblies may be fitted with lifting means for selectively positioning the contact assembly between an operating position and a raised position. In the operating position the contact surfaces of the contact shoes are in contact with the back side of the conveyor belt, while in the raised position, the contact surfaces are spaced apart or lifted from the back side of the conveyor belt. Accordingly, one or more downstream contact assemblies may be raised to reduce heating of the advancing corrugated paperboard sheet in view of the increased energy transfer efficiency of the present invention. Alternatively, one or more of raised contact assemblies may be lowered to run the corrugated paperboard at a higher linear speed because of the increased heat transfer efficiency achievable with the present invention.

A method according to the present invention is for setting the adhesive in corrugated paperboard during the manufacturing thereof. The method preferably uses an apparatus of the type including a plurality of heating chests arranged in side-by-side relation and defining a series of laterally extending heating surfaces, and a conveyor belt positioned opposite the series of heating surfaces. More particularly, the method includes the steps of: driving the conveyor belt to advance a corrugated paperboard sheet longitudinally along a predetermined path of travel along the heating surfaces, and slidably contacting and pressing upon a back side of the driven conveyor belt so as to urge the advancing corrugated paperboard sheet into substantially uniform contact with the laterally extending heating surfaces despite any thermally induced bowing or deflection thereof.

The step of slidably contacting the back side of the conveyor belt includes the steps of providing a series of contact assemblies associated with the back side of the conveyor belt as described above, and biasing each of the contact shoes for urging the contact surface of the contact shoe against the back side of the conveyor belt.

In addition, the method also preferably includes the step of setting a minimum clearance between each contact shoe and the heating surface to thereby prevent each contact shoe from fully pressing against adjacent portions of the back side of the conveyor belt when the apparatus is operated without the corrugated paperboard sheet in place adjacent a respective portion of the conveyor belt. The minimum clearance is also less than a corresponding minimum thickness of a corrugated paperboard sheet to be heated so that the contact shoe is biased even for the minimum thickness sheet.

Each of the contact shoes preferably includes a generally rectangular plate. Accordingly, the method preferably further includes the step of arranging the plates in laterally spaced apart relation defining longitudinally extending gaps between adjacent plates, and mounting adjacent ones of the contact assemblies in laterally staggered relation to laterally offset the longitudinally extending gaps in adjacent assemblies.

Another method aspect according to the invention includes the steps of sensing a temperature of the corrugated paperboard sheet downstream from the heating surfaces, and lowering or lifting predetermined ones of the contact assemblies so that the contact shoes thereof are positioned to transfer more or less heat to thereby maintain a predetermined exit temperature for the sheet.

DETAILED DESCRIPTION OF THE PREFERRED EMBODIMENTS

Figure 1:
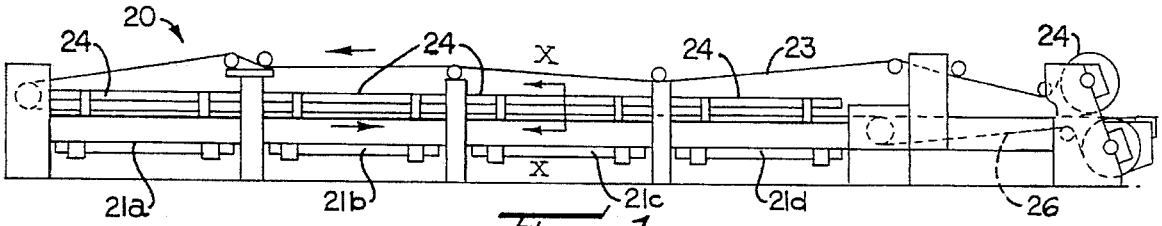
Fig-1 (PRIOR ART)
FIG. 1 is a schematic side elevational view of a prior art double facer for advancing and heating a corrugated paperboard sheet to the adhesive therein.
Figure 2:
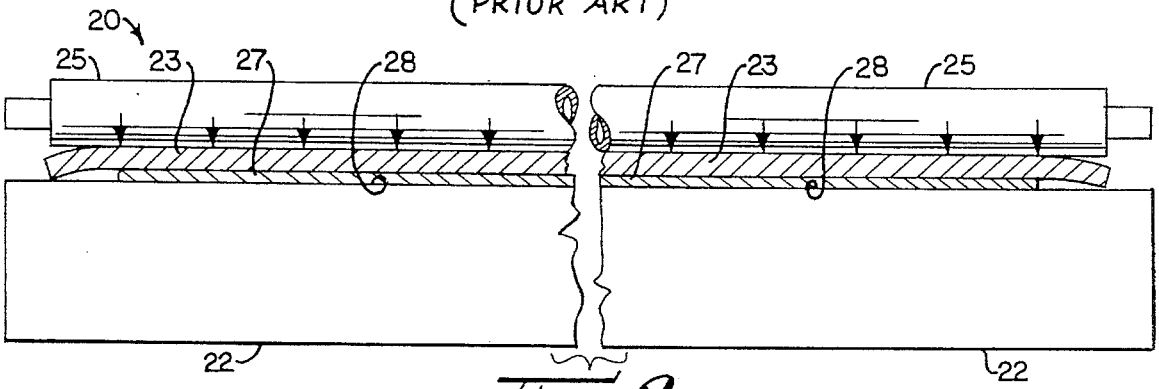
Fig-2 (PRIOR ART)
FIG. 2 is a greatly enlarged fragmentary schematic cross-sectional view of the prior art double facer taken along lines x—x of FIG. 1 and illustrating a heating chest during start-up of the apparatus before any thermally induced bowing of the heating chest has occurred.
Figure 3:
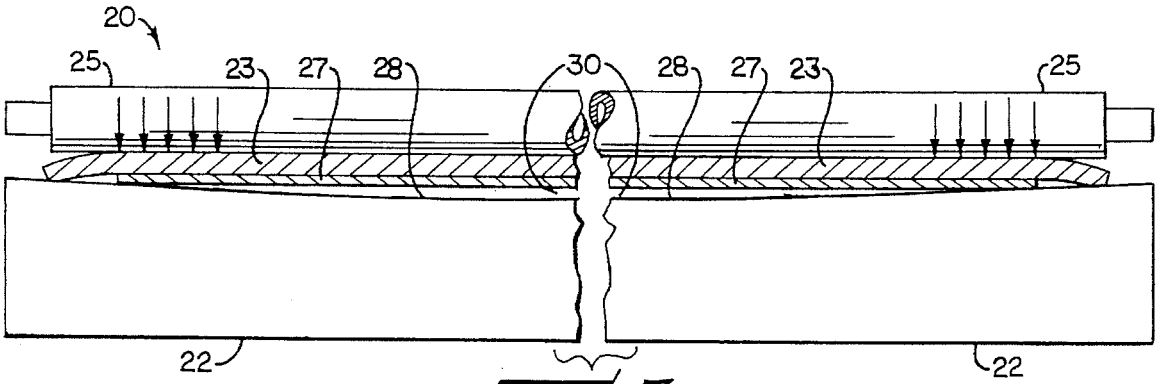
Fig-3 (PRIOR ART)
FIG. 3 is a greatly enlarged fragmentary schematic cross-sectional view of the prior art double facer taken along lines x—x of FIG. 2 and illustrating a heating chest having a thermally induced bow as during operation of the apparatus, the bow being somewhat exaggerated for clarity.

The present invention will now be described more fully hereinafter with reference to the accompanying drawings, in which preferred embodiments of the invention are shown. This invention may, however, be embodied in many different forms and should not be construed as limited to the embodiments set forth herein; rather, applicant provides these embodiments so that this disclosure will be thorough and complete, and will fully convey the scope of the invention to those skilled in the art. Like numbers refer to like elements throughout.

Referring to FIGS. 4–7, the apparatus 40 for transferring heat to set the adhesive in corrugated paperboard manufacturing is first explained. As would be readily understood by those skilled in the art, conventional corrugated paperboard is constructed of two opposing liners and an intervening fluted sheet secured together using an adhesive. The adhesive is typically a starch-based adhesive applied as a liquid that must be dried or set during manufacturing of the corrugated paperboard.

The illustrated embodiment of the apparatus 40 of the present invention includes a series of elongate steam heating chests 42 positioned in side-by-side relation to define a series of laterally extending heating surfaces 48 for heating a corrugated paperboard sheet 47 to thereby dry or set the adhesive. The heating chests 42 are of a conventional type heated to about 350° F. by a steam supply, as would be readily appreciated by those skilled in the art. For a typical adhesive, the heating chests 42 raise the temperature of the corrugated sheet 47 from its preheated temperature of about 120° F. at the entry of the apparatus 40, to about 180°–200° F. at the exit end of the apparatus 40.

Each of the chests 42 is elongate and typically about 18 or 24 inches in the longitudinal direction and about 90 to 100 inches in the lateral direction as would be readily understood by those skilled in the art. Conventional roll-based machines typically required about 18 to 28 such heating chests, while only about 7 to 16 such chests 42 may be needed for a typical installation using the present invention. The number of heating chests depends upon desired speed of operation and other factors as would be readily understood by those skilled in the art.

The apparatus 40 also includes an endless conveyor belt 43 of a conventional type as would also be readily appreciated by those skilled in the art. The conveyor belt 43 includes a front or working side for engaging a corrugated paperboard sheet 47 and advancing the sheet along a predetermined longitudinal path of travel over the series of heating chests 42. The conveyor belt 43 requires backing pressure to ensure that the relatively fast moving sheet 47 sufficiently contacts the heating surfaces 48 to absorb heat and set the adhesive.

Figure 4:
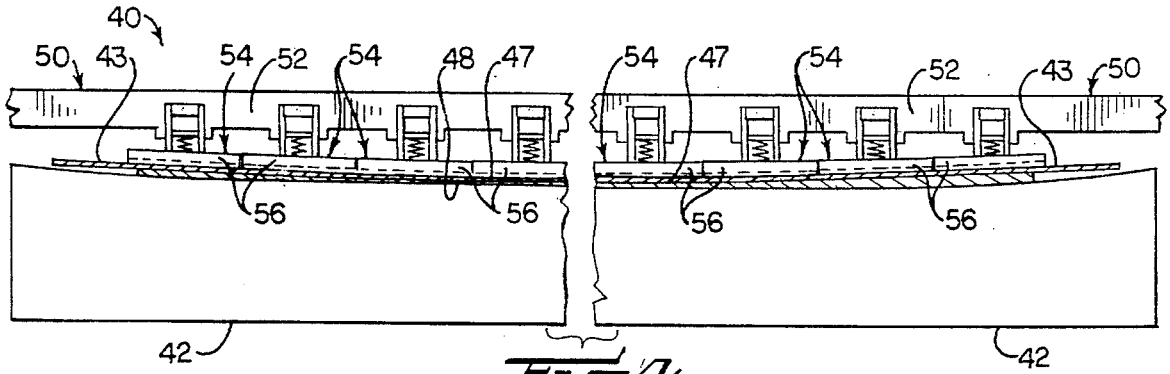
FIG. 4 is a fragmentary cross-sectional view of an apparatus according to the invention similar to the view shown in FIG. 3.

Unfortunately, as illustrated in FIG. 4, a heating chest 42 has a tendency to develop an inward bow or deflection in a medial portion of its upper heating surface 48 during operation of the apparatus 40. This thermally induced deflection is caused by the difference in temperature between the various wall portions of the heating chest 42 as hot steam is passed through the chest, while the relatively cool corrugated paperboard sheet 47 cools the heating surface 48 of the chest because of the heat transferred from the chest to the sheet. The bow is typically more pronounced in the upstream heating chests 42 because of the relatively cooler temperature of the sheet at that area.

Although the bow is shown somewhat exaggerated in the drawings for clarity, a bow of ⅛ inch has been measured at the bottom wall of typical chest 42, thereby indicating that the bow at the heating surface 48 is likely to be even greater. Accordingly, such a thermally induced bow presented a number of difficulties for prior roll-based systems, including blistering of a medial portion of the sheet and crushing of the edge portions of the sheet. In either case, poor quality or scrap corrugated paperboard was produced.

The apparatus 40 of the present invention includes sliding contact means associated with a back side of the conveyor belt 43 for slidably contacting and pressing upon the back side of the conveyor belt to urge the advancing corrugated paperboard sheet 47 into substantially uniform contact with the laterally extending heating surfaces 48 despite any thermally induced deflection or bowing thereof. In the illustrated embodiment, the sliding contact means is provided by a plurality of contact assemblies 50. As would be readily understood by those skilled in the art, the contact assemblies 50 according to the present invention may be installed on new lines or, alternately, the contact assemblies may be readily substituted for existing rolls in retrofit applications.

Each contact assembly 50 preferably includes a laterally extending frame 52 positioned adjacent the back side of the conveyor belt 43. A plurality of contact shoes 54 are carried by the frame 52 and arranged in side-by-side relation. As illustrated, each of the contact shoes 54 has a contact surface for slidably contacting the back side of the conveyor belt 43. Each of the contact shoes 54 preferably includes a generally rectangular steel plate 56 of mild steel defining the contact surface. The mild steel is readily formed, durable, and yet will not prematurely wear the conveyor belt 43. Another suitable material for the plates 56 may be a ceramic which will give even longer wear.

For a typical installation to produce 87 inch wide corrugated paperboard, for example, about 10 contact shoes 54 may be used, each having a contact surface about 8 and ¾ inch wide with about a ¼ inch gap between adjacent surfaces. As shown perhaps most clearly in FIGS. 5 and 6, all of the generally rectangular plates 56 preferably have uniform dimensions and each of the plates 56 preferably has a length corresponding to the underlying heating chest 42, which, as stated above, is typically about 18 or 24 inches in the longitudinal direction. A slight gap may also be formed between longitudinally adjacent plates 56. The contact shoes 54 of the present invention provide a backing pressure over substantially the full extent of the heating surface 48 of the heating chest 42, in sharp contrast to prior roll-based systems which provided only spaced apart lineal contact with the conveyor belt.

Figure 5:
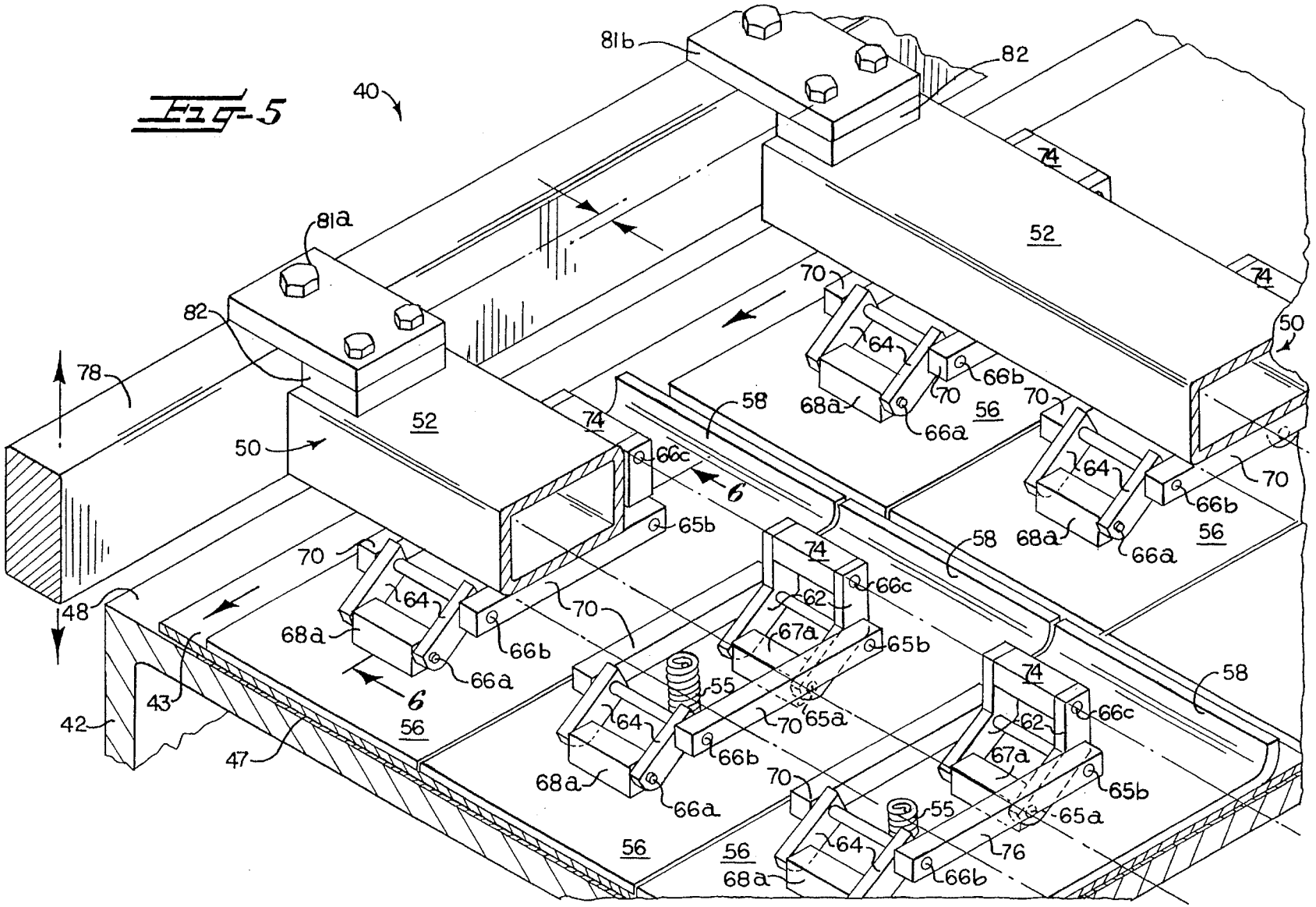
FIG. 5 is a greatly enlarged perspective view of a portion of the apparatus according to the present invention.
Figure 6:
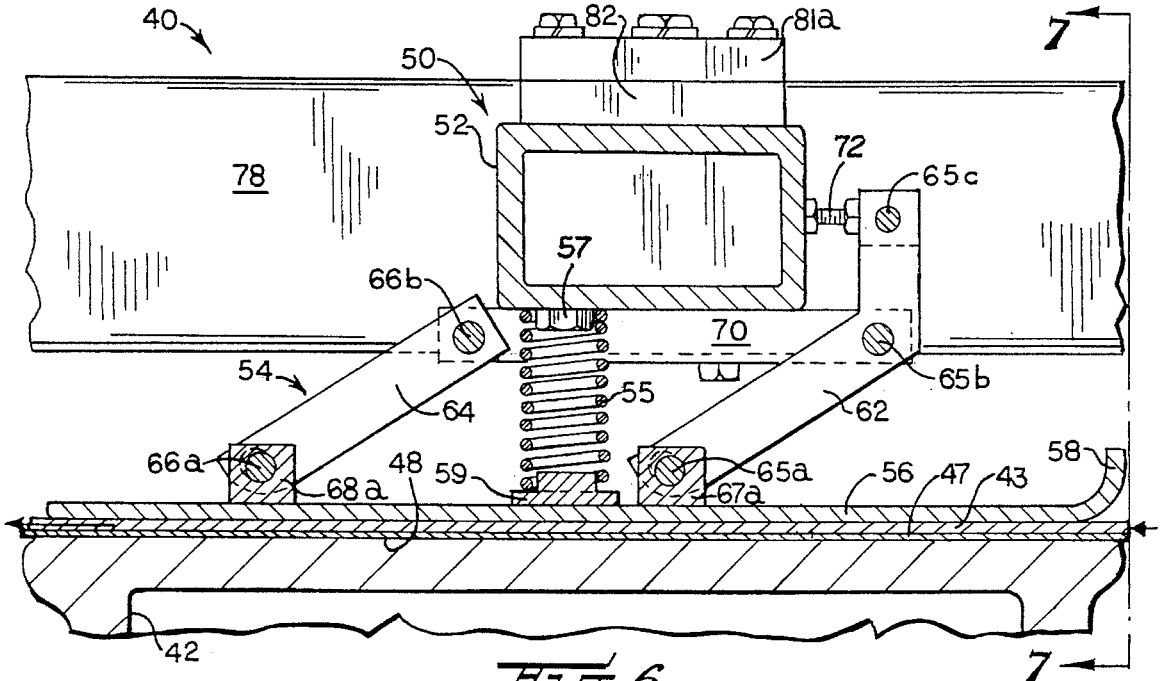
FIG. 6 is a greatly enlarged side cross-section view taken along lines 6—6 of FIG. 5 illustrating a portion of one contact assembly according to the invention.
Figure 7:
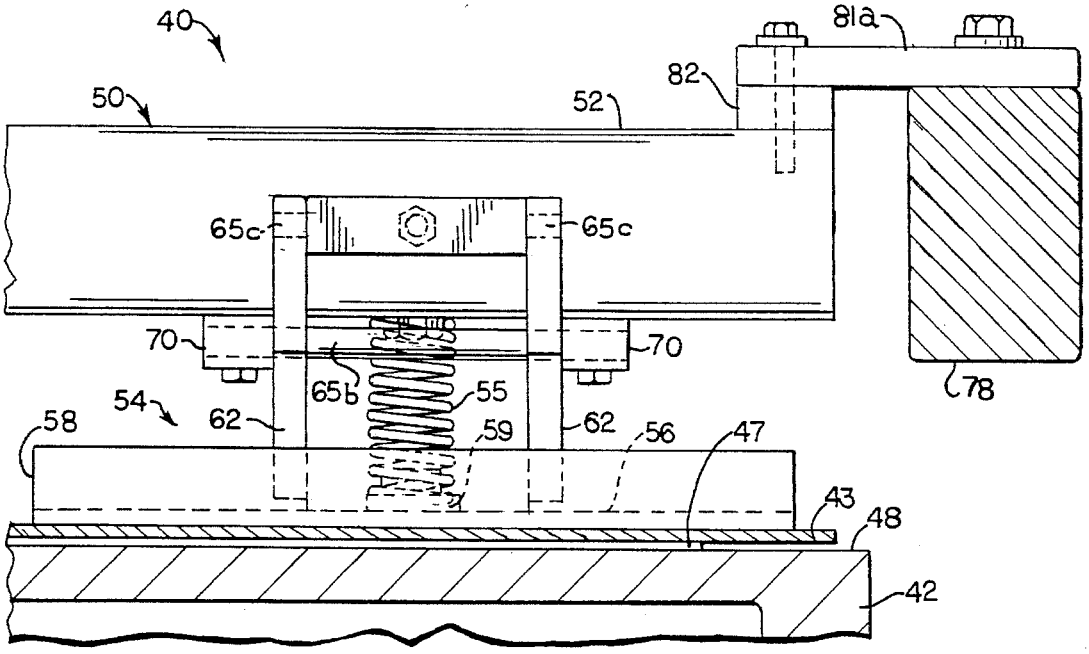
FIG. 7 is a cross-sectional view of the portion of the contact assembly taken along lines 7—7 of FIG. 6.

As also shown in FIGS. 5, 6 and 7, each of the generally rectangular plates 56 includes an upturned leading edge 58 to facilitate sliding contact with the conveyor belt 43. In other words, the upturned leading edge 58 prevents snagging of the conveyor belt 43, particularly at the seam area of the belt, not shown. The radius of curvature of the upturned end 58 may be about the same as for a conventional backing roll.

The contact assembly 50 further includes biasing means operatively connected between the frame 50 and each of the contact shoes 54 for biasing the contact surface thereof against the back side of the conveyor belt 43. In the illustrated embodiment, the biasing means is provided by respective coil springs 55 having a predetermined spring constant and a predetermined amount of initial compression. In addition, the amount of initial compression for each spring 55 may be set by a predetermined height of an enlarged diameter area of a spacer pad 59. In the illustrated embodiment, the spacer pad 59 has a lower enlarged diameter area and an upper reduced diameter area defining a shoulder therebetween. The lower end of the coil spring 55 rests upon the shoulder and the upper end of the spring is captured by the head of a bolt 57 as shown best in FIG. 6.

The initial compression of the spring 55 and the spring constant establish the initial bias force applied to the contact shoe 54. For a typical application, for example, a coil spring 55 having a free length of about 2.25 inches and a 130 lbs./in. spring constant may be set to have an initial length of about 2 inches. More particularly, the amount of initial compression, and hence the initial biasing force, may be set based upon a desired pressure for the contact surface of each contact shoe 54 as would be readily understood by those skilled in the art. The desired pressure may also be based upon a measurement of current draw on a motor driving the conveyor belt 43, so that the motor is operated in a desired range. Other biasing means and approaches for setting the initial bias of a coil spring 55 are also contemplated by the present invention.

Figure 8:
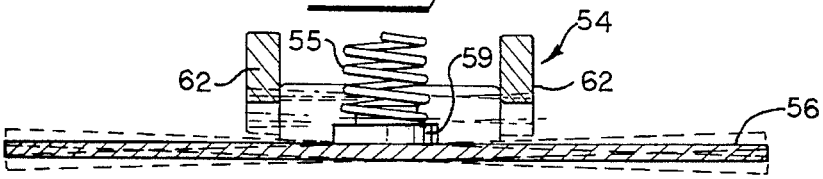
FIG. 8 is a cross-sectional view of the portion of the contact assembly as shown in FIG. 7 and illustrating the pivotal movement of the contact shoe about an imaginary longitudinal centerline thereof.
Figure 9:
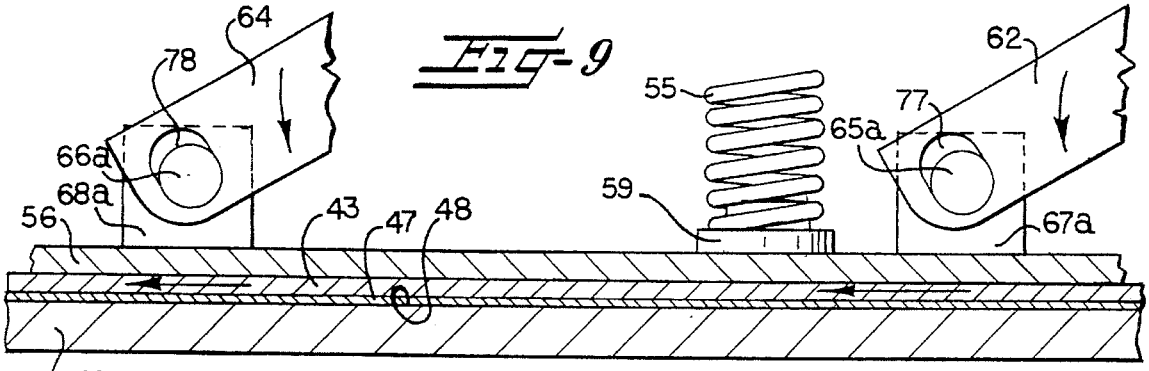
FIG. 9 is a greatly enlarged cross-sectional view of a portion of a contact shoe as shown in FIG. 6 illustrating the enlarged pivot shaft openings in the arms for providing the pivotal movement of the contact shoe about its imaginary longitudinal centerline.

Referring now additional to FIGS. 8 and 9, the shoe mounting means is explained. The shoe mounting means permits each of the contact shoes 54 to be independently movable along a predetermined path of travel generally normal to the heating surfaces 48. In other words, each contact shoe 54 may move independently in an up and down motion to accommodate bowing of the underlying heating surface 48. In addition, the up and down movement also accommodates variations in the belt thickness, particularly to accommodate the belt seam, and variations in the thickness of the corrugated paperboard sheet 47 being manufactured.

The shoe mounting means includes a front pair of arms 62 and a rear pair of arms 64. Each of the pairs of arms 62, 64 are connected at a lower end by lower front and rear pivot shafts, or spigots, **65*a*, 66*a*, respectively. The pivot shafts 65*a*, 66*a* are provided by turned end portions of respective front and rear lower mounting blocks 67*a*, 68*a* secured to the rectangular plate 56. Each of the pairs of mounting arms 62, 64 is connected at an upper end by upper front and rear pivot shafts, or spigots 65*b*, 66*b*, respectively. These upper pivot shafts 65*b*, 66*b* are preferably provided by reduced diameter end portions of respective shafts carried by a parallel pair of upper mounting blocks 70 secured to the frame 52**.

Another feature of the invention is stop means being operatively connected between the frame and each of the contact shoes 54 for defining a predetermined minimum clearance between each of the contact surfaces and a respective portion of the heating surface 48. Accordingly, pressure is relieved on the back side of the conveyor belt 43 when the apparatus 40 is operated and the belt is driven without the corrugated paperboard sheet 47 being located underlying the respective portion of the conveyor belt, to thus reduce unnecessary wear on the belt. The corrugated paperboard sheet 47 may not be present when the apparatus 40 is initially started, or at the edges of the heating surfaces 48 as when a narrow width sheet is being manufactured. In addition, the clearance is set so that backing pressure is provided for a minimum thickness 47 sheet.

As shown perhaps best in FIGS. 5 and 6, the stop means is preferably provided by angled upper portions of the front arms 62 and uppermost pivot shafts, or spigots, **65*c*. The pivot shafts 65*c* are preferably provided by turned end portions of a stop block 74 wherein the position of the stop block 74 relative to the frame 52 is also determined by an adjustable bolt 72 connected to the frame. The adjustable bolt 72 is set for the minimum thickness of the corrugated paperboard sheet 47** to be manufactured while still providing a clearance for when no sheet is present. Other arrangements for stop means are also contemplated by the present invention as will be appreciated by those skilled in the art.

Referring now particularly to FIGS. 8 and 9 another feature of the shoe mounting means according to the invention is explained. Enlarged or elongated openings 77 at the lower end of the front pair of arms 62 and enlarged openings 78 at the rear pair of arms 64 cooperate with their respective pivot shafts **65*a*, 66*a* to permit the generally rectangular plate 56 of the contact shoe 54 to pivot with respect to an imaginary longitudinal centerline of the contact surface. Accordingly, the contact shoes 54 may laterally pivot to more readily conform to any bowing of the heating surfaces 48**.

Figure 10:
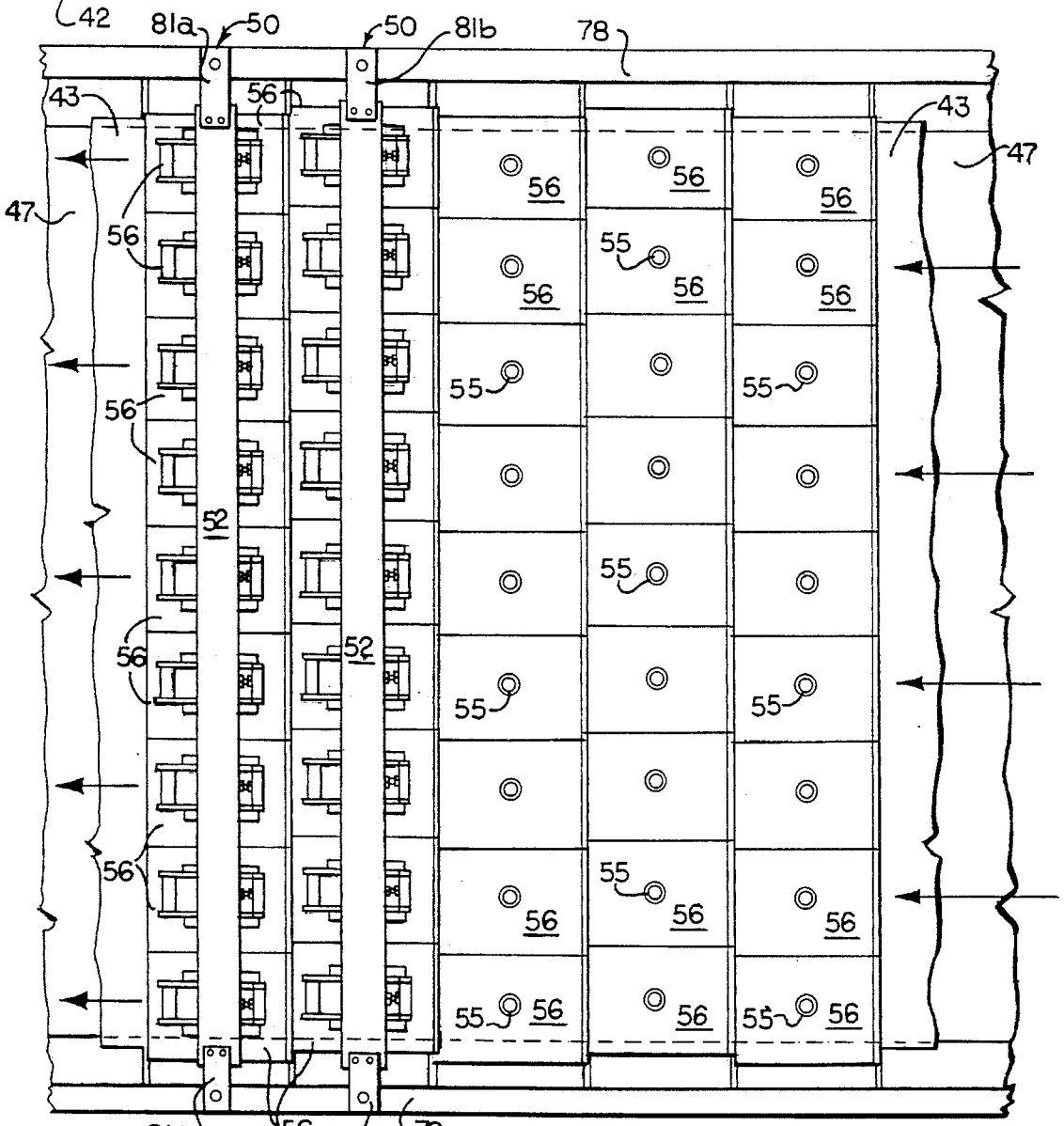
FIG. 10 is a greatly enlarged plan view of the apparatus according to the invention with the upper portion of the conveyor belt removed for clarity and illustrating the staggered arrangement of adjacent contact assemblies.

As shown in FIG. 10, another feature of the present invention for ensuring uniform backing pressure is explained. As would be readily understood by those skilled in the art, the apparatus 40 preferably includes a pair of opposing longitudinally extending side rails 78. The contact assemblies 50 may thus be readily secured to the rails 78 by spacers 82 and mounting plates **81*a*, 81*b* having slightly different lengths. Accordingly, the longitudinally extending gaps between adjacent plates 56 may be staggered or offset so that a continuous line of no backing force is not presented to the back side of the conveyor belt 43. As shown in the illustrated embodiment, the contact assemblies 50 are mounted so that each is laterally staggered or offset from adjacent ones by alternating the mounting plates 81***a*, 81*b* for adjacent assemblies 50.

Figure 11:
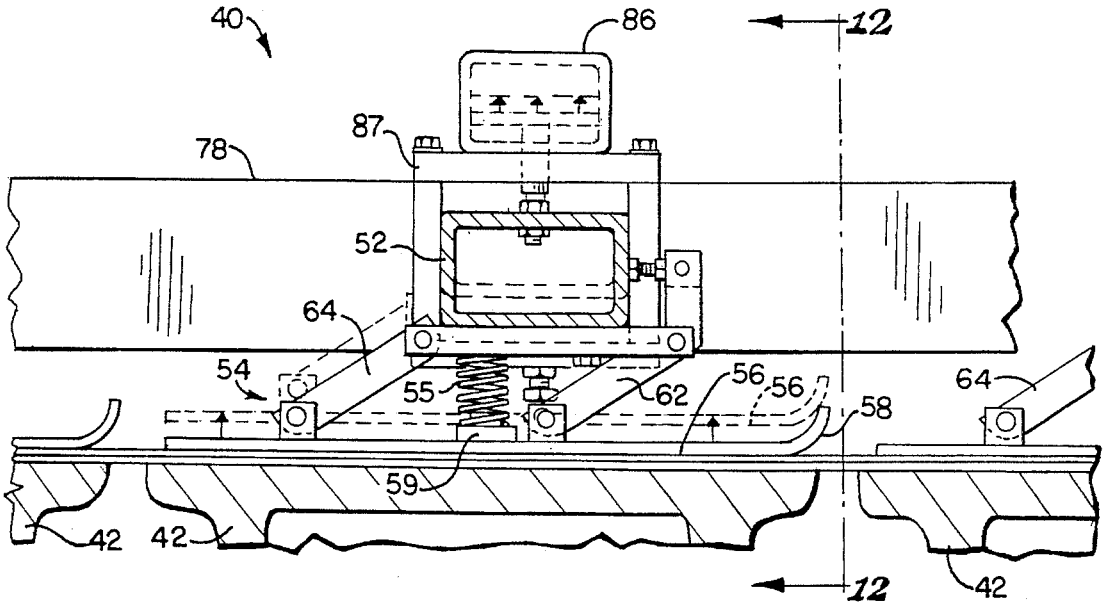
FIG. 11 is a cross-sectional view of another embodiment of the present invention including lifting means for providing selectable movement between a raised and a lowered position.
Figure 12:
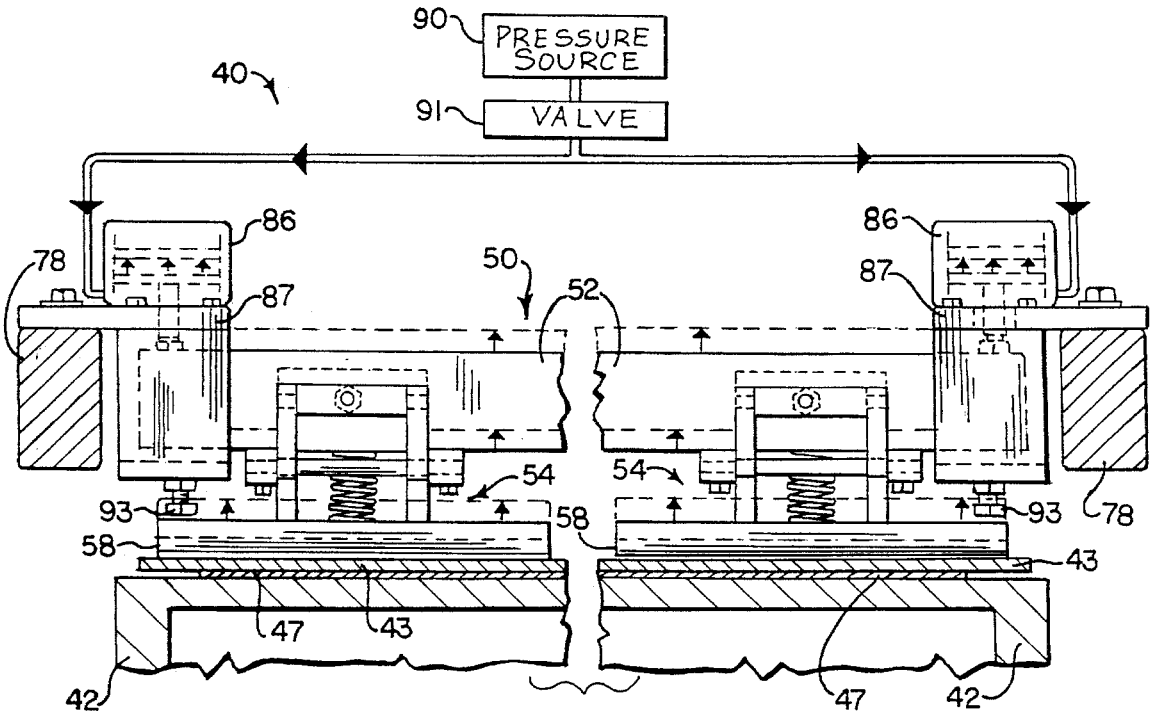
FIG. 12 is a fragmentary cross-sectional view of the apparatus taken along lines 12—12 of FIG. 11.

Referring now to FIGS. 11 and 12, yet another aspect of the present invention is explained. All or predetermined ones of the contact assemblies 50 may include lifting means for selectively positioning a contact assembly between an operating position or a raised position. In the operating position, the contact surfaces of the contact shoes 54 are positioned against the conveyor belt 43. In the raised position, the frame 52 and, accordingly, the contact shoes 54 are raised so that no backing pressure is applied to the back side of the conveyor belt 43.

As shown in the illustrated embodiment, a pair of pneumatically operable actuators or pistons 86 may be connected to a contact assembly frame 52 at the respective opposing ends thereof to raise or lower the contact assembly 50 responsive to a pressure source 90 and suitable control valve 91. In addition, a lower stop position may be set by stop bolts 93. Thus, the lifting means may be connected to all or predetermined ones of the contact assemblies 50 to permit control of the amount of heat imparted to the advancing corrugated paperboard sheet 47 to thereby maintain the temperature of the sheet within a predetermined range.

Referring now collectively again to all of the drawing figures, a method according to the present invention for setting the adhesive in corrugated paperboard during the manufacturing thereof is explained. The method preferably uses an apparatus 40 of the type including a plurality of heating chests 42 arranged in side-by-side relation defining a series of laterally extending heating surfaces 48, and a conveyor belt 43 positioned opposite the series of heating surfaces. More particularly, the method includes the steps of: driving the conveyor belt 43 to advance a corrugated paperboard sheet 47 longitudinally along a predetermined path of travel over the heating surfaces 48, and slidably contacting and pressing upon a back side of the driven conveyor belt so as to urge the advancing corrugated paperboard sheet 47 into substantially uniform contact with the laterally extending heating surfaces despite any thermally induced bowing or deflection thereof and without crushing the sheet.

The step of slidably contacting the back side of the conveyor belt 43 preferably includes the steps of providing a series of contact assemblies 50 associated with the back side of the conveyor belt as described above, and biasing each of the contact shoes 54 for urging the contact surface of the contact shoe against the back side of the conveyor belt 43.

In addition, the method also preferably includes the step of setting a minimum clearance between each contact shoe 54 and the heating surface 48 to thereby prevent each contact shoe from fully pressing against adjacent portions of the back side of the conveyor belt when the apparatus 40 is operated without the corrugated paperboard sheet 47 in place adjacent a respective portion of the conveyor belt, while still also imparting a bias force to a sheet having a predetermined minimum thickness.

Each of the contact shoes 54 preferably includes a generally rectangular plate 56. Accordingly, the method preferably further includes the step of arranging the plates 56 in laterally spaced apart relation defining longitudinally extending gaps between adjacent plates, and mounting adjacent contact assemblies 50 in laterally staggered relation to laterally offset the longitudinally extending gaps in the adjacent assemblies.

Another method aspect according to the invention includes the steps of sensing a temperature of the corrugated paperboard sheet 47 downstream from the heating surfaces 48, and lifting or lowering predetermined ones of the contact assemblies 50 so that the backing pressure is controlled to maintain the temperature of the sheet 47 within a predetermined range. As stated above, a typical desired temperature for the sheet 47 at the exist of the apparatus 40 may preferably be in the range of about 180° to 200° F. for a typical adhesive.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. An apparatus for setting an adhesive in corrugated paperboard during the manufacturing thereof, said apparatus comprising:

a series of elongate heating chests positioned in side-by-side relation and defining a series of laterally extending heating surfaces;

a conveyor belt positioned opposite said series of heating surfaces for advancing a corrugated paperboard sheet longitudinally along a predetermined path of travel over said heating surfaces; and a plurality of contact assemblies associated with a back side of said conveyor belt for slidably contacting and pressing upon the back side of said conveyor belt to urge the advancing corrugated paperboard sheet into substantially uniform contact with said laterally extending heating surfaces, each of said contact assemblies comprising a laterally extending frame positioned adjacent the back side of said conveyor belt, a plurality of contact shoes carried by said frame and arranged in side-by-side laterally extending relation, each of said contact shoes having a contact surface for slidably contacting the back side of said conveyor belt, biasing means operatively connected between said frame and each of said contact shoes for independently biasing the contact surface of each of said shoes against the back side of said conveyor belt, mounting means for mounting each of said contact shoes to said frame so that the contact surface of each of said shoes is independently moveable along a predetermined path of travel generally normal to said conveyor belt, and stop means operatively connected between said frame and each of said contact shoes for defining a predetermined minimum spacing between each of said contact surfaces and a respective portion of said heating surface so that backing pressure is provided for a corrugated paperboard sheet having a predetermined minimum thickness and to thereby relieve pressure on the back side of said conveyor belt when the apparatus is operated without the corrugated paperboard sheet in place adjacent a respective portion of said conveyor belt.

2. An apparatus according to claim 1 wherein said shoe mounting means comprises a plurality of arms and respective pivot shafts cooperating therewith for pivotally securing opposing ends of each arm to said frame and each of said contact shoes, respectively.

3. An apparatus according to claim 2 wherein each of said arms has an enlarged opening in an end thereof to cooperate with respective pivot shafts for permitting pivotal movement of each of said contact surfaces about an imaginary longitudinal center line thereof.

4. An apparatus according to claim 1 wherein said bias means comprises respective springs operatively connected between each of said contact shoes and said frame.

5. An apparatus according to claim 1 further comprising a pair of rails longitudinally extending along opposite sides of said heating surfaces, and contact assembly mounting means for mounting said plurality of contact assemblies so that each contact assembly is associated with a respective laterally extending heating surface.

6. An apparatus according to claim 5 wherein said plurality of contact shoes comprise respective generally rectangular plates having substantially uniform dimensions, and wherein each generally rectangular plate has a length substantially corresponding to a length of a respective heating surface.

7. An apparatus according to claim 6 wherein each of said generally rectangular plates includes a laterally extending upturned leading edge to facilitate sliding contact with said conveyor belt.

8. An apparatus according to claim 6 wherein respective generally rectangular plates of each contact assembly are arranged in laterally spaced apart relation defining longitudinally extending gaps between adjacent plates, and wherein said contact assembly mounting means includes means for mounting adjacent ones of said contact assemblies in laterally staggered relation to laterally offset the longitudinally extending gaps in adjacent assemblies.

9. An apparatus according to claim 1 wherein one or more of said contact assemblies further comprise lifting means connected to respective frames of said one or more contact assemblies for selectively positioning same between an operating position, wherein the contact surfaces of said contact shoes are in contact with the back side of said conveyor belt, and a raised positioned, wherein said contact surfaces are spaced apart from the back side of said conveyor belt.

10. An apparatus for setting an adhesive in corrugated paperboard during the manufacturing thereof, said apparatus comprising:

heating means for defining a heating surface;

a conveyor belt positioned opposite said heating surface for advancing a corrugated paperboard sheet longitudinally along a predetermined path of travel over said heating surface; and sliding contact means associated with a back side of said conveyor belt for slidably contacting and pressing upon the back side of said conveyor belt so as to urge the advancing corrugated paperboard sheet into substantially uniform contact with the heating surface, said sliding contact means comprising a plurality of contact assemblies, each contact assembly comprising a laterally extending frame positioned adjacent the back side of said conveyor belt, a plurality of contact shoes carried by said frame and arranged in side-by-side laterally extending relation, each of said contact shoes having a contact surface for slidably contacting the back side of said conveyor belt, respective springs operatively connected between said frame and each of said contact shoes for independently biasing the contact surface of each of said shoes against the back side of said conveyor belt, mounting means for mounting each of said contact shoes to said frame so that the contact surface of each of said shoes is independently moveable along a predetermined path of travel generally normal to said conveyor belt, and stop means operatively connected between said frame and each of said contact shoes for defining a predetermined minimum spacing between each of said contact surfaces and a respective portion of said heating surface so that backing pressure is provided for a corrugated paperboard sheet having a predetermined minimum thickness and to thereby relieve pressure on the back side of said conveyor belt when the apparatus is operated without the corrugated paperboard sheet in place adjacent a respective portion of said conveyor belt.

11. An apparatus according to claim 10 wherein said plurality of contact shoes comprise respective generally rectangular plates.

12. An apparatus according to claim 11 wherein each of said generally rectangular plates includes a laterally extending upturned leading edge to facilitate sliding contact with said conveyor belt.

13. A contact assembly adapted to be positioned on an apparatus of the type for setting an adhesive in corrugated paperboard during the manufacturing thereof, the apparatus comprising heating means for defining a heating surface and a conveyor belt positioned opposite the heating surface for advancing a corrugated paperboard sheet along a predetermined path of travel over said heating surface, said contact assembly comprising:

a frame adapted to be positioned adjacent the back side of the conveyor belt and extending laterally thereacross;

a plurality of contact shoes carried by said frame and arranged in side-by-side laterally extending relation, each of said contact shoes having a contact surface adapted for slidably contacting the back side of said conveyor belt;

biasing means operatively connected between said frame and each of said contact shoes and adapted for independently urging the contact surface of each of said shoes against the back side of the conveyor belt;

mounting means for mounting each of said contact shoes to said frame so that the contact surface of each of said shoes is independently moveable along a predetermined path of travel generally normal to the conveyor belt, and stop means operatively connected between said frame and each of said contact shoes for defining a predetermined minimum spacing between each of said contact surfaces and a respective portion of said heating surface so that backing pressure is provided for a corrugated paperboard sheet having a predetermined minimum thickness and to thereby relieve pressure on the back side of said conveyor belt when the apparatus is operated without the corrugated paperboard sheet in place adjacent a respective portion of said conveyor belt.

14. A contact assembly according to claim 13 wherein said shoe mounting means comprises a plurality of arms and respective pivot shafts cooperating therewith for pivotally securing opposing ends of each arm to said frame and each of said contact shoes, respectively.

15. A contact assembly according to claim 14 wherein each of said arms has an enlarged opening in an end thereof to cooperate with respective pivot shafts for permitting pivotal movement of each of said contact surfaces about an imaginary longitudinal center line thereof.

16. A contact assembly according to claim 13 wherein said bias means comprises respective springs operatively connected between each of said contact shoes and said frame.

17. A contact assembly according to claim 13 wherein said plurality of contact shoes comprise respective generally rectangular plates having substantially uniform dimensions.

18. A contact assembly according to claim 17 wherein each of said generally rectangular plates includes a laterally extending upturned leading edge adapted to facilitate sliding contact with the conveyor belt.

19. A contact assembly according to claim 13 further comprising lifting means connected to said frame and adapted for selectively positioning said frame between an operating position, wherein the contact surfaces of said contact shoes are adapted to be in contact with the back side of the conveyor belt, and a raised positioned, wherein said contact surfaces are adapted to be spaced apart from the back side of the conveyor belt.

20. A contact assembly adapted to be positioned on an apparatus of the type for setting an adhesive in corrugated paperboard during the manufacturing thereof, the apparatus comprising heating means for defining a heating surface and a conveyor belt positioned opposite the heating surface for advancing a corrugated paperboard sheet along a predetermined path of travel over said heating surface, said contact assembly comprising:

a frame adapted to be positioned adjacent the back side of the conveyor belt and extending laterally thereacross;

a plurality of contact shoes carried by said frame and arranged in side-by-side laterally extending relation, each of said contact shoes having a contact surface adapted for slidably contacting the back side of said conveyor belt;

shoe mounting means for mounting each of said contact shoes to said frame so that each contact surface is adapted to be independently moveable along a predetermined path of travel generally normal to the heating surface;

respective springs operatively connected between said frame and each of said contact shoes and adapted for independently urging the contact surface of each of said shoes against the back side of the conveyor belt, and stop means operatively connected between said frame and each of said contact shoes for defining a predetermined minimum spacing between each of said contact surfaces and a respective portion of said heating surface so that backing pressure is provided for a corrugated paperboard sheet having a predetermined minimum thickness and to thereby relieve pressure on the back side of said conveyor belt when the apparatus is operated without the corrugated paperboard sheet in place adjacent a respective portion of said conveyor belt.

21. A contact assembly according to claim 20 wherein said shoe mounting means comprises a plurality of arms and respective pivot shafts cooperating therewith for pivotally securing opposing ends of each arm to said frame and each of said contact shoes, respectively.

22. A contact assembly according to claim 21 wherein each of said arms has an enlarged opening in an end thereof to cooperate with respective pivot shafts for permitting pivotal movement of each of said contact surfaces about an imaginary longitudinal center line thereof.

23. A contact assembly according to claim 19 wherein said plurality of contact shoes comprise respective generally rectangular plates having substantially uniform dimensions.

24. A contact assembly according to claim 23 wherein each of said generally rectangular plates includes a laterally extending upturned leading edge adapted to facilitate sliding contact with the conveyor belt.

25. A method for uniformly heating corrugated paperboard during the manufacturing thereof to set adhesive in the corrugated paperboard with an apparatus of the type including a plurality of heating chests arranged in side-by-side relation and defining a series of laterally extending heating surfaces, and a conveyor belt positioned opposite the series of heating surfaces, the method comprising the steps of:

driving the conveyor belt to advance a corrugated paperboard sheet longitudinally along a predetermined path of travel over the heating surfaces; and slidably contacting and pressing upon a back side of the driven conveyor belt to urge the advancing corrugated paperboard sheet into substantially uniform contact with the adjacent laterally extending heating surfaces despite any thermally induced deflection thereof, said step of slidably contacting the back side of the conveyor belt comprising the steps of providing a series of contact assemblies associated with the back side of the conveyor belt, each contact assembly comprising a plurality of contact shoes arranged in side-by-side relation extending laterally across the conveyor belt, each of the contact shoes having a contact surface for slidably contacting the back side of the conveyor belt and being mounted to said frame for independent movement in a direction generally normal to the back side of the conveyor belt, biasing each of the contact shoes for independently urging the contact surface of each of the contact shoes against the back side of the conveyor belt, and defining a predetermined minimum spacing between each of said contact surfaces and a respective portion of said heating surface so that backing pressure is provided for a corrugated paperboard sheet having a predetermined minimum thickness and to thereby relieve pressure on the back side of said conveyor belt when the apparatus is operated without the corrugated paperboard sheet in place adjacent a respective portion of said conveyor belt.

26. A method according to claim 25 further comprising the step of setting a minimum spacing between each contact shoe and the heating surface so that backing pressure is provided for a corrugated paperboard sheet having a predetermined minimum thickness and to thereby relieve pressure on the back side of said conveyor belt when the apparatus is operated without the corrugated paperboard sheet in place adjacent a respective portion of the conveyor belt.

27. A method according to claim 25 wherein each of the contact shoes comprises a generally rectangular plate, and further comprising the step of arranging the generally rectangular plates in laterally spaced apart relation defining longitudinally extending gaps between adjacent plates, and further comprising the step of mounting adjacent ones of the contact assemblies in laterally staggered relation to laterally offset the longitudinally extending gaps in adjacent assemblies.

28. A method according to claim 25 further comprising the steps of sensing a temperature of the corrugated paperboard sheet downstream from the heating surfaces, and lowering or lifting predetermined ones of the contact assemblies to transfer more or less heat, respectively, so as to maintain the temperature of the corrugated paperboard sheet within a predetermined range.

* * * * *